US005249542A

United States Patent [19]

Latham

[11] Patent Number: 5,249,542

[45] Date of Patent: Oct. 5, 1993

[54] CAMBERED AIRFOIL, AND CRAFT COMPRISING SAME

[76] Inventor: Ronald D. Latham, Rte. 3, Box 184-A, Apex, N.C. 27502

[21] Appl. No.: 892,790

[22] Filed: Jun. 3, 1992

[51] Int. Cl.[5] ..... B63H 9/08

[52] U.S. Cl. ..... 114/103; 114/102

[58] Field of Search ..... 114/39.1, 39.2, 102-105, 114/108; 244/123, 210, 219, DIG. 1

[56] References Cited

U.S. PATENT DOCUMENTS

| | | | |
|---|---|---|---|
| 4,344,377 | 8/1982 | Gram | 114/103 |
| 4,369,724 | 1/1983 | Weiss | 114/39.1 |
| 4,437,426 | 3/1984 | Latham | 114/103 |
| 4,467,741 | 8/1984 | Walker | 114/103 |
| 4,530,301 | 7/1985 | Latham | 114/102 |
| 4,625,671 | 12/1986 | Nishimura | 114/103 |
| 4,649,848 | 3/1987 | Belvedere | 114/103 |
| 4,685,410 | 8/1987 | Fuller | 114/102 |
| 4,699,073 | 10/1987 | Farneti | 114/103 |
| 4,708,079 | 11/1987 | Magnan | 114/103 |
| 4,848,258 | 7/1989 | Priebe | 114/103 |
| 4,972,789 | 11/1990 | Greppi | 114/90 |
| 5,038,699 | 8/1991 | Cochran | 114/103 |

*Primary Examiner*—Robert J. Oberleitner
*Assistant Examiner*—Clifford T. Bartz
*Attorney, Agent, or Firm*—Steven J. Hultquist

[57] ABSTRACT

A self-cambering airfoil, comprising a mast to which a camber inducer member is secured for rotational movement about the axis of the mast. The camber inducer member extends rearwardly from the mast to a trailing portion having a batten realignment cavity therein. The realignment cavity receives a flexible batten element therein and accommodates recambering of the flexible batten element when the camber inducer member repositions from a first camber position thereof to a second camber position thereof. An elongate flexible batten element is positioned at a leading edge thereof in the batten realignment cavity of the camber inducer member and extends rearwardly therefrom to a trailing edge. A skin covering comprises two main panels each extending rearwardly from the mast to a trailing edge and joined to one another at their respective trailing edges to form a trailing portion of the skin covering. The main panels are of a size and shape defining an enclosure containing the batten element, with the trailing edge of the batten element being in interior abutting contact with the skin covering at the trailing portion thereof and in a state of compression within the enclosure defined by the skin covering such that in the first camber position of the camber inducer member, the batten element interiorly abuts, distends and imparts a camber profile to a first one of the two main panels, and in the second camber position of the camber inducer member, the batten element interiorly abuts, distends and imparts a camber profile to a second one of the two main panels. The self-cambering airfoil is usefully employed as a wingsail structural assembly of a wind-propelled craft such as a sailboat, sailplane, or iceboat.

20 Claims, 6 Drawing Sheets

CAMBERED AIRFOIL, AND CRAFT COMPRISING SAME

BACKGROUND OF THE INVENTION

1. Field of the Invention

This invention relates generally to an airfoil of cambered character which is adjustably self-cambering in response to variations in wind speed and direction. The invention also relates to a craft, e.g., a boat, comprising such airfoil.

2. Description of the Related Art

In the deployment and use of sail craft, e.g., sailboats, iceboats, etc., which utilize wind as a motive power source, the aerodynamic principles of thrust (lift) and drag govern the efficiency of the sail or airfoil member.

In an effort to improve the aerodynamic efficiency of sail craft, wing-type airfoils have been evolved which typically include a framework supporting a double-surfaced shroud constructed of flexible material which is deformable in response to impingement of wind thereon. These double-surfaced wing-type airfoils have been constructed to provide a cambered airfoil shape on one of the main shroud surfaces, i.e., a convex curvature from a leading edge region of the shroud surface to the trailing edge region of such surface, to mimic the shape and achieve the high lift, low drag performance of a fixed (aircraft-type) wing.

U.S. Pat. No. 4,437,426 issued Mar. 20, 1984 to Ronald D. Latham discloses a wing type airfoil assembly suitable for use on boats or other craft, which comprises a central load carrying spar having disposed about its opposite ends an upper tip member and a lower root member. A flexible cable is interconnected in a general loop fashion around and between the tip and root members, with a forward run spaced forwardly of the spar and a rear run spaced rearwardly of the spar. A slat is secured to the forward run of the cable, with the trailing edge of the slat being in spaced relationship to the spar to define a slot area therebetween. A skin covering extends between the rear run and the spar, and is wrapped around the spar to create a double surface wing panel whose leading edge is formed by the spar and whose trailing edge is formed by the rear run of the cable. The spar of this assembly is reposed in a journaled arrangement over a holding shaft secured in turn to the craft so that the entire assembly is rotatable about the holding shaft in response to wind speed and direction.

U.S. Pat. No. 4,530,301 issued Jul. 23, 1985 to Ronald D. Latham describes a variable camber airfoil assembly including a rigid leading edge member pivotally mounted about the leading edge of the airfoil such that it can move from side-to-side in order to improve the entry of the airfoil into the wind. The means for limiting side-to-side movement of the rigid leading edge member comprises a mast extending substantially the entire length or height of the wing-type airfoil and extending between two laterally spaced sides forming the rigid leading edge member.

U.S. Pat. No. 4,369,724 issued Jan. 25, 1983 to John Weiss describes a sail comprising two symmetric fabric sections attached together at the edges to form a fabric skin which is suspended by an edge tension mechanism functioning to control forward and trailing edge tension to tune and reverse the airfoil section. The sail's fabric sections are supported by an internal arrangement of a mast and a curved boom, with a control rope slideably connected to the mast at the internal mast boom connection. The control rope is tensioned and the mast is moveable in either direction along the boom to set up differential tensional relationships between the respective edges of the sail to in turn impart a desired airfoil shape to the sail in either direction.

U.S. Pat. No. 4,649,848 issued Mar. 17, 1989 to Mark S. Belvedere discloses a sail assembly having a sock enclosing the mast and a main section with a trailing edge. The main section joins the sock at a sock seam. A plurality of batten pockets are provided on the main section and extend freely within the sock to near the mast. Flexible rib pairs opposite the mast are clamped tangentially to full length battens, with the battens defining the shape of the ribs and the orientation of the leading edge. The assembly is adapted to automatically position the leading edge member into relative wind and to define a smooth aerodynamic shape of the sock blending with both sides of the main section as the sail is variously trimmed.

U.S. Pat. No. 4,685,410 issued Aug. 11, 1987 to Robert R. Fuller describes an airfoil sail system for a boat having a mast, comprising a front airfoil which is pivotal about an axis defined by the mast and which has leading and trailing edges. A rear airfoil is also provided which has leading and trailing edges. The front and rear airfoils are operatively coupled by a coupling means so that rotation of the front airfoil about its axis effects a counter-rotation of the rear airfoil to permit adjustment of the camber of the airfoil sail system.

U.S. Pat. No. 4,848,258 issued Jul. 18, 1989 to Paul D. Priebe describes an airfoil system for water vessels, comprising at least one mast to which a plurality of yards are attached. The yards are in the shape of an airfoil that is symmetrical from front to back, and asymmetrical from side to side. Fabric attached to the periphery of the yards forms the surface of the sail, with the mast enclosed in the sail. The mast is rotatable to sail at different angles to the wind and to allow tacking.

U.S. Pat. No. 4,972,789 issued Nov. 27, 1990 to Luigi Greppi discloses a sailboat mast structure comprising a tubular body with anchor means for two distinct sailcloths forming a wingsail. The tubular body has a cross section divided in two parts by an axis transverse to the longitudinal axis of the boat; a first part faces the bow, and a second part faces the stern. The first part has a markedly convex or substantially semielliptical curved profile. The second part has a rounded tip profile or a substantially semicircular profile. The anchor means are positioned along two generatrices crossing two points which are symmetrical in respect of the center or coinciding with the center of the first part.

SUMMARY OF THE INVENTION

In one aspect, the present invention relates to a self-cambering airfoil, comprising:

(i) a generally vertically positionable mast;

(ii) a camber inducer member secured to the mast for rotational movement about the axis of the mast, and extending rearwardly from the mast to a trailing portion having a batten realignment cavity therein of a size and shape to receive a flexible batten element therein and accommodate recambering of the flexible batten element when the camber inducer member repositions from a first camber position thereof to a second camber position thereof;

(iii) an elongate flexible batten element positioned at a leading edge thereof in the batten realignment cavity of the camber inducer member and extending rearwardly therefrom to a trailing edge;

(iv) a skin covering comprising two main panels each extending rearwardly from the mast to a trailing edge and joined to one another at their respective trailing edges to form a trailing portion of the skin covering, the main panels being of a size and shape defining an enclosure containing the batten element, with the trailing edge of the batten element being in interior abutting contact with the skin covering at the trailing portion thereof and in a state of compression within the enclosure defined by the skin covering such that in the first camber position of the camber inducer member, the batten element interiorly abuts, distends and imparts a camber profile to a first one of the two main panels, and in the second camber position of the camber inducer member, the batten element interiorly abuts, distends and imparts a camber profile to a second one of the two main panels.

The self-cambering airfoil broadly described above may in a specific embodiment further comprise a head member joined to an upper portion of the mast and extending rearwardly therefrom and a foot member joined to a lower portion of the mast and extending rearwardly therefrom, with the skin covering at an upper part thereof being coupled to the head member and the skin covering at a lower part thereof being coupled to the foot member.

In another aspect, the self-cambering airfoil may further comprise a slat member generally coextensive in length with the mast and pivotally mounted forwardly of the mast and in parallel alignment therewith, such slat member having a trailing edge in spaced relationship to the skin covering to define a slot therebetween for enhancing the lift and thrust of the airfoil.

In the self-cambering airfoil described above, the enclosure defined by the skin covering may contain the camber inducer member therewithin.

A self-cambering airfoil according to the present invention in a specific aspect may further comprise a multiplicity of batten elements associated with at least one camber inducer member, wherein the batten elements are in vertically spaced-apart relationship to one another.

Such type of self-cambering airfoil may advantageously comprise a multiplicity of discrete unitary camber inducer members disposed in spaced-apart relationship to one another along the length of the mast and independently secured to the mast for rotational movement about the axis of the mast.

In a further aspect, the self-cambering airfoil of the invention may be constructed such that the camber inducer member comprises a main camber body of vertically elongate and horizontally streamline shape including a convergent forward portion engaging the mast for rotational movement about the axis of the mast, and a convergent rearward portion, with a horizontal and forwardly extending slot in the convergent rearward portion of the main camber body, and a batten socket inset mounted in the horizontal and forwardly extending slot, wherein the batten socket insert has a symmetrical cleft passage therein as the batten realignment cavity. In this self-cambering airfoil, the main camber body may suitably be formed of a form material of construction.

The self-cambering airfoil described in the preceding paragraph may advantageously comprise a multiplicity of horizontal and forwardly extending slots in the main camber body, in vertically spaced-apart relationship to one another, and with each of the horizontal and forwardly extending slots having a batten socket insert mounted therein.

In another aspect, the present invention relates to a craft comprising a pylon having a holding shaft mounted thereon and extending upwardly therefrom, with a self-cambering airfoil mounted on the holding shaft for rotation about the holding shaft, wherein the self-cambering airfoil may be of the forms and structures variously described above.

Other aspects and features of the invention will be more fully apparent from the ensuing disclosure and appended claims.

DETAILED DESCRIPTION OF THE INVENTION, AND PREFERRED EMBODIMENTS THEREOF

Figure 1:
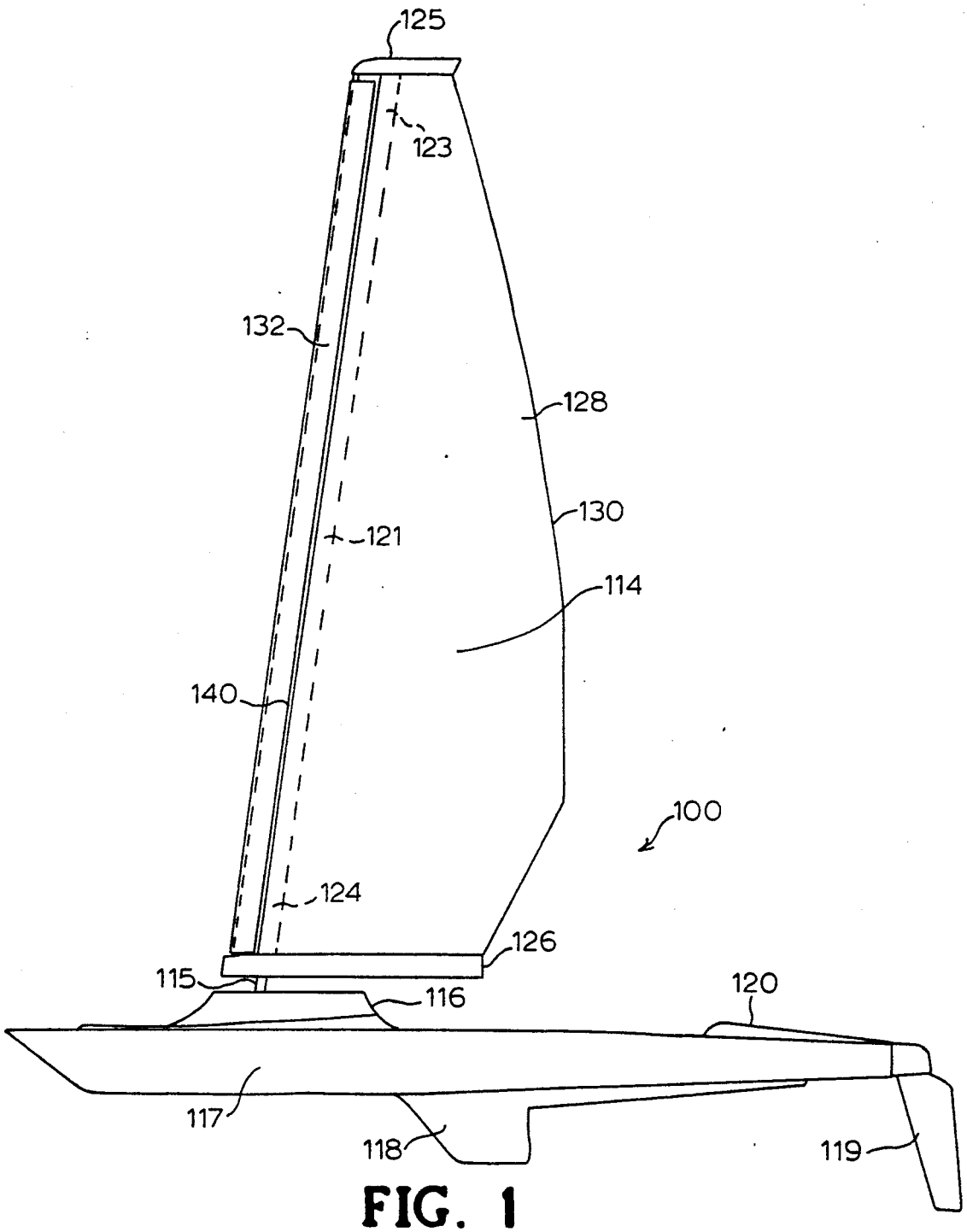
FIG. 1 is a side elevation of a craft featuring the self-cambering airfoil, according to one embodiment of the invention.

Referring now to the drawings, FIG. 1 shows a vessel 100 featuring a variable camber, double-surface, wing-like wind drive system adapted to provide a driving thrust for the vessel in the functional manner of a wind sail.

The vessel 100 includes a hull 117 of a streamlined character, featuring on its underside a keel 118, with a rudder 119 disposed at its stern and connected to a rudder control arm 120. Extending vertically upwardly from the hull 117 is a pylon 116. On the top surface of the pylon is mounted a wing post 115.

The airfoil assembly 114 of the craft as shown in FIG. 1 comprises a mast 121. The mast is generally vertically aligned in orientation, being slightly canted from the vertical in the embodiment shown. The mast is suitably of tubular shape or otherwise of generally circular cross-section (such cross section being taken transverse to the longitudinal axis of the mast), and the mast is joined at an upper portion 123 thereof to a tip member 125 and at a lower portion 124 thereof to a foot member 126. The purpose of the tip member 125 and foot member 126 is to provide (with the mast) a rigidified structure to which the skin 128 may be coupled. Thus, the skin 128 extends from a trailing edge 130 in the forward direction to the mast 121. In the embodiment shown, the skin circumscribes the forward portion of the mast, and on the side opposite to that shown, extends rearwardly to the trailing edge 130, thereby forming an "envelope." The envelope has two main surface portions, or panels, defining therebetween an interior volume containing the mast as well as further structural elements hereinafter more fully described.

At its upper end, the skin 128 may if desired be coupled to the tip member 125, and at its lower extremity, the skin may if desired be coupled to foot member 126, in any suitable manner, as for example by mechanical fasteners, ropes or cables. Alternatively, the skin 128 may simply be joined to the mast 121, with the battens (described hereinafter in greater detail) disposed within the skin envelope serving to maintain its shape, with the mast, skin, and tip and foot members acting in unitary fashion with respect to airfoil alignment.

Mounted forwardly of the mast 121 and in proximity thereto is a vertically elongated slat 132 which at its upper end is secured to the tip member 125 and at its lower end is secured to the foot member 126. Slat 132 preferably includes a shell, e.g., of rigid fiberglass or other suitable material, which extends around the core member of the slat in wrap-around fashion, and may for example be fabricated as more fully described in my prior U.S. Pat. No. 4,437,426, the disclosure of which hereby is incorporated herein by reference.

The slat 132 is in spaced relationship to the mast, being parallelly aligned therewith to define a slot 140 therebetween. The slat is suitably provided with a slat sheet (line), as hereinafter more fully described, to assist in providing a desired alignment of the slat with respect to the airfoil skin configuration, and to achieve desired thrust characteristics for propulsion of the craft under the impetus of a propelling wind.

The skin 128 may be of any suitable character, as for example mylar, polypropylene, or other web material of construction commonly employed in the manufacture of sails for conventional sail craft. The skin may be of any suitable thickness, as for example a thickness on the order of from about 0.005 to 0.050 inch thickness in the case of mylar or other high strength thin film material of construction.

In the FIG. 1 embodiment, the mast 121 is journaled about wing post 115 for free rotational movement about the wing post. Accordingly, the mast at its lower portion may be constructed in any appropriate manner for coupling with the wing post, as for example by the provision of a cylindrical cavity in the mast in which the upper end of the wing post is received. Further, such cylindrical cavity in the mast may be provided with bearings or other friction-reducing means therein by which the coupling of the mast to the wing post provides a desired rotational freedom. Further, the mast may be secured to the foot member 126 in any suitable manner.

Figure 2:
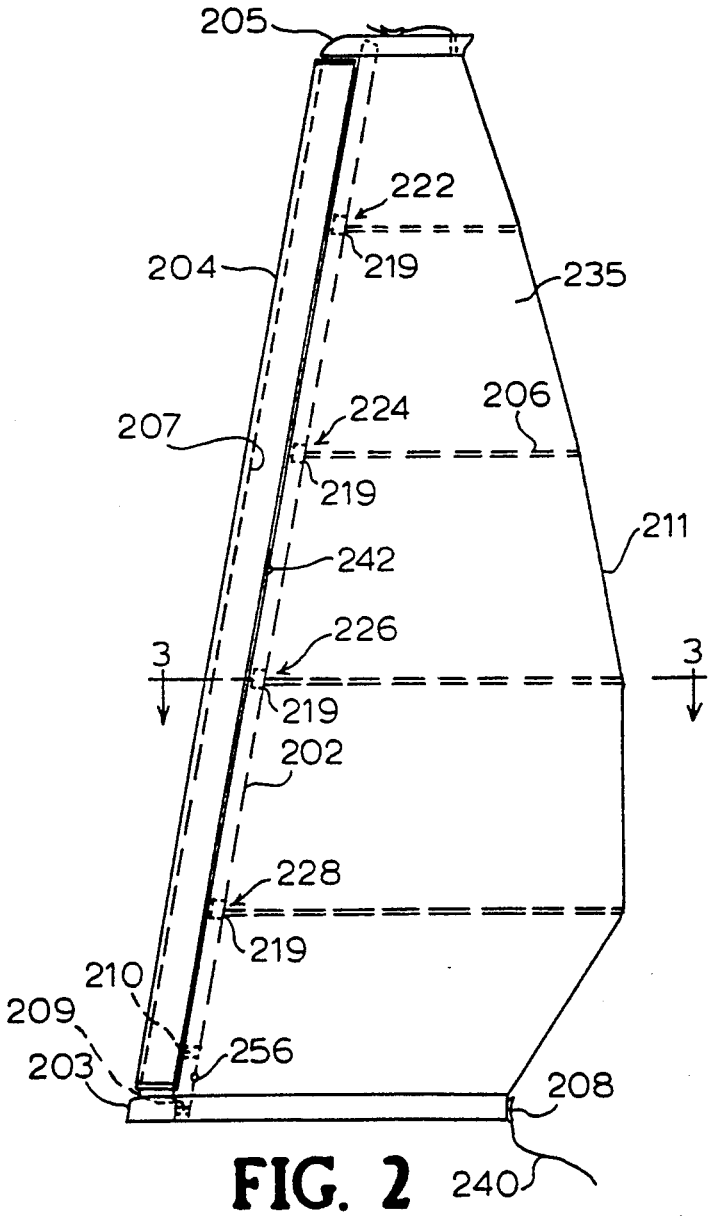
FIG. 2 is a side elevation view of an airfoil assembly according to one embodiment of the invention.

Referring now to FIG. 2, there is shown a side elevation view of an airfoil assembly according to one embodiment of the invention, such as may usefully be employed as the airfoil of a craft of the type shown in FIG. 1.

In the FIG. 2 airfoil assembly, the mast 202 is generally vertically aligned and at its lower portion is secured to the foot member 203. The lower portion of the mast also includes a cylindrical cavity therein containing a lower bushing 209 and an upper bushing 210. These bushings may have chamfered center openings to facilitate set-down of the mast on the wing post, with the central opening of the lower bushing extending through the entire body of the bushing and the central opening of the upper bushing extending only part way through the body of the upper bushing. These respective bushings also reinforce the mast at its lower portion which receives the wing post (not shown in FIG. 2) therewithin.

At its upper end, the mast 202 is secured to the tip member 205.

A narrow slat 204 with a streamlined cross-section and a length generally equal to that of the mast is located forward of and parallel to the mast. The slat is pivotally suspended on a cable 207 that passes through the leading edge of the slat and is tensioned between the forward-most part of the tip member 205 and the forward-most part of the foot member 203, thereby allowing the trailing edge of the slat to swing freely from side-to-side about the cable. The slat may be constructed and arranged for limiting its lateral movement in any suitable manner, as for example by the arrangement described in my aforementioned U.S. Pat. No. 4,437,426. As an example, a line 240 may be attached to the approximate vertical center of the trailing edge of slat 204 and passed through an eye member 242 that is positioned on the front of the mast at its vertical mid-width point. This line may be allowed to fall vertically to the bottom of the airfoil assembly, where it may be passed through a cleat-type locking device 208 attached to the aft portion of foot member 203, thereby structurally limiting the side-to-side swing of the slat as well as the size of the slot formed between the trailing edge of the slot and the leading edge of the mast.

A camber inducer member 219 of generally streamlined cross-section is mounted in direct rotational sliding contact with the mast, at each of the vertically spaced-apart positions 222, 224, 226, and 228 so that it can rotate freely about the vertical axis of the mast. At each of these four positions 222, 224, 226, and 228, along the rear edge of the associated camber inducer 219, a thin, narrow, elongate, flexible, but "springy," batten member 206 extends rearwardly and generally horizontally from the rear segment of the camber inducer member 219, and terminates generally at the trailing edge 211 of the airfoil assembly.

As described in connection with FIG. 1, the airfoil of FIG. 2 features a skin 235 which extends from the trailing edge 211 of the airfoil forwardly toward the mast 200. The skin circumscribes the leading portion of the mast and on the side opposite to that shown in FIG. 2 extends rearwardly to the trailing edge 211, thereby forming an envelope containing the mast 200, the camber inducer member 219, and the batten elements 206. The skin may be secured to the mast by a snap 256 or other mechanical fastener lockably associated with a corresponding mating structure on the mast. The tautness of the skin 235 acts as a limiting constraint on the rotational side-to-side swing of the camber inducer member about the rotational axis of the mast, and also predetermines the extent of the camber (curvate profile) which may be induced in the respective panels of the skin 235.

Figure 3A:
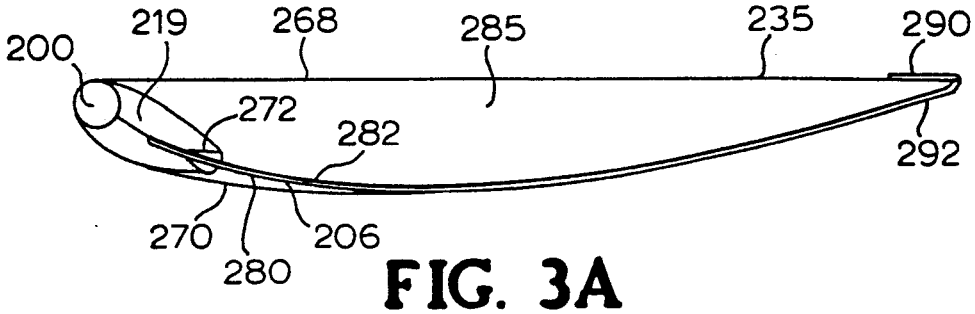
FIG. 3A is a cross-sectional view of the airfoil assembly of FIG. 2, taken along line 3—3 thereof, in a starboard tack.

FIG. 3A is a cross-sectional view of the airfoil assembly of FIG. 2, taken along line 3—3 thereof, in a starboard tack.

As shown, the skin 235 at the forward end of the airfoil assembly circumscribes the forward portion of mast 200. Secured to the mast, in rotational relationship thereto, is camber inducer member 219, which is constructed to grippingly engage the mast, as shown. The mast may be furnished with detent structures or other limit-stop means, whereby the rotation of the camber inducer member 219 on the mast 200 may be limited, or alternatively, the camber inducer member 219 may be freely rotatable on the mast 200 through a full 360° arc.

At its rear portion, the camber inducer member 219 features a cavity 272, which may for example take the form of a slot or other passage, in which is reposed the flexible batten element 206, which on a first side 280 thereof bears distendingly against the panel 270 of the skin 235, and which on its opposite side 282 faces the interior volume 285 of the airfoil assembly.

By this arrangement, the panel 270 is distended in the cambered profile shown, while the opposite panel 268 of skin 235 remains substantially less cambered, e.g., linear or substantially uncambered in profile, or if in the presence of wind impinging thereon, having a slightly distorted (concave) profile.

Figure 3B:
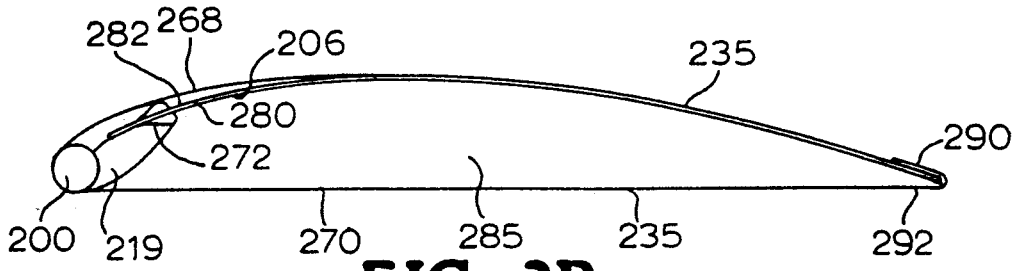
FIG. 3B is a cross-sectional view of the airfoil assembly of FIG. 2, taken along line 3—3 thereof, in a port tack.

The cavity 272 is of a size and shape permitting the flexible batten element 206 to assume either of two distinct camber-producing positions—the starboard position shown in FIG. 3A, or the corresponding port position shown in FIG. 3B, wherein the airfoil assembly of FIG. 3 is shown in an opposite tack position. The corresponding features and elements of FIG. 3A are numbered identically in FIG. 3B.

It will be seen that the camber conformations of FIGS. 3A and 3B are substantially mirror image conformations, and that in the port tack position shown in FIG. 3B, the flexible batten element 206 bears tensionally against the inner surface of panel 268 of skin 235, to cause a convex curvature of such panel, relative to the substantially flat substantially conformation of such panel in the view shown in FIG. 3A. Correspondingly, in the FIG. 3B conformation, the opposite side 280 of the flexible batten element 206 faces the interior volume 285 of the "envelope" formed by skin 235 (containing the mast 200, camber inducing member 219, and flexible batten element 206).

The airfoil assembly shown in FIGS. 3A and 3B may suitably be adjusted with respect to the tension thereof in a conventional manner, by a trailing edge flap 290 of the skin, which is a continuation of the length of panel 270 of skin 235. Flap 290 may be tensionally secured against the trailing end 292 of flexible batten element 206, whereby the specific shape of the panels and camber surface profile thereof may be selectively adjusted to a predetermined extent. The flap 290 may be secured to the exterior surface of the opposite panel 268 in any suitable manner, as for example by Velcro® fastener elements, or mechanical fasteners, such as snaps, buckles, buttons, or other means which may be adjustably arranged to vary the tension of the skin relative to the flexible batten element disposed therewithin. Alternatively, the batten element may protrude rearwardly of the skin envelope and be retained in place by a strap extending from the rearward edge of each panel and around the rearwardly protruding batten element.

Figure 4:
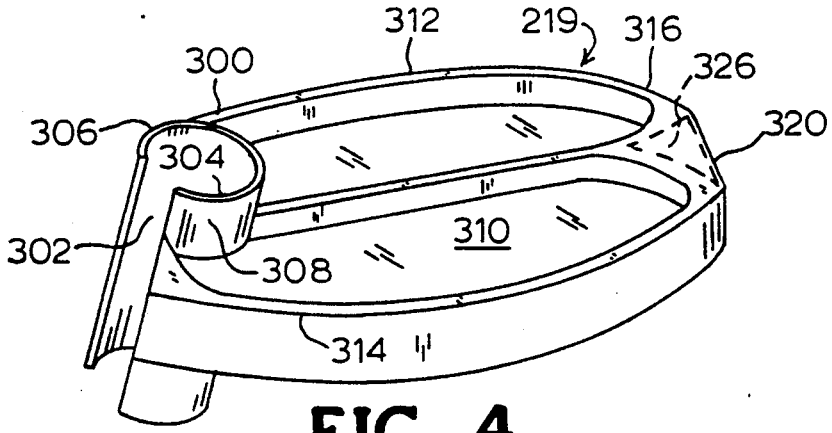
FIG. 4 is a top plan view of a camber inducer member of a type usefully employed in the airfoil assembly of FIG. 2.

FIG. 4 is a perspective view of a camber inducer member 219 of the type utilized in the airfoil assembly of FIGS. 2, 3A, and 3B.

As shown, the camber inducer member 219 at its leading edge portion 300 features an interior cavity 302 bounded by inner facing surface 304 thereof. In this manner, the cavity 302, which is of a size and shape to accommodate receipt of the mast therewithin, is bounded by the forward extensions 306 and 308, as shown.

The camber inducer member 219 along its intermediate portion 310 has arcuate exterior surfaces 312 and 314 providing a smooth fit with the forward portion of the skin envelope, as for example is shown in FIGS. 3A and 3B. At its rearward portion 316, the cambered inducer member features a cavity 320 of generally convergent character defining at its inner extremity an interior bore or passage. The cavity 320 and interior bore or passage together form a retention structure for receiving the forward end of the flexible batten element therein, with the arcuate converging wall surfaces 326 of cavity 320 serving to readily permit the repositioning of the flexible batten element from a first camber position to a second camber position, of opposite character to the first camber position.

The camber inducer member 219 may be formed of any suitable material of construction, as for example structural foam materials, thermoplastic or thermoset polymeric materials, wood, aluminum, or other suitable material, preferably of lightweight character, and suitable strength characteristics to withstand the rotational wear and flexural stresses imposed on such member in use of the airfoil assembly.

Figure 5:
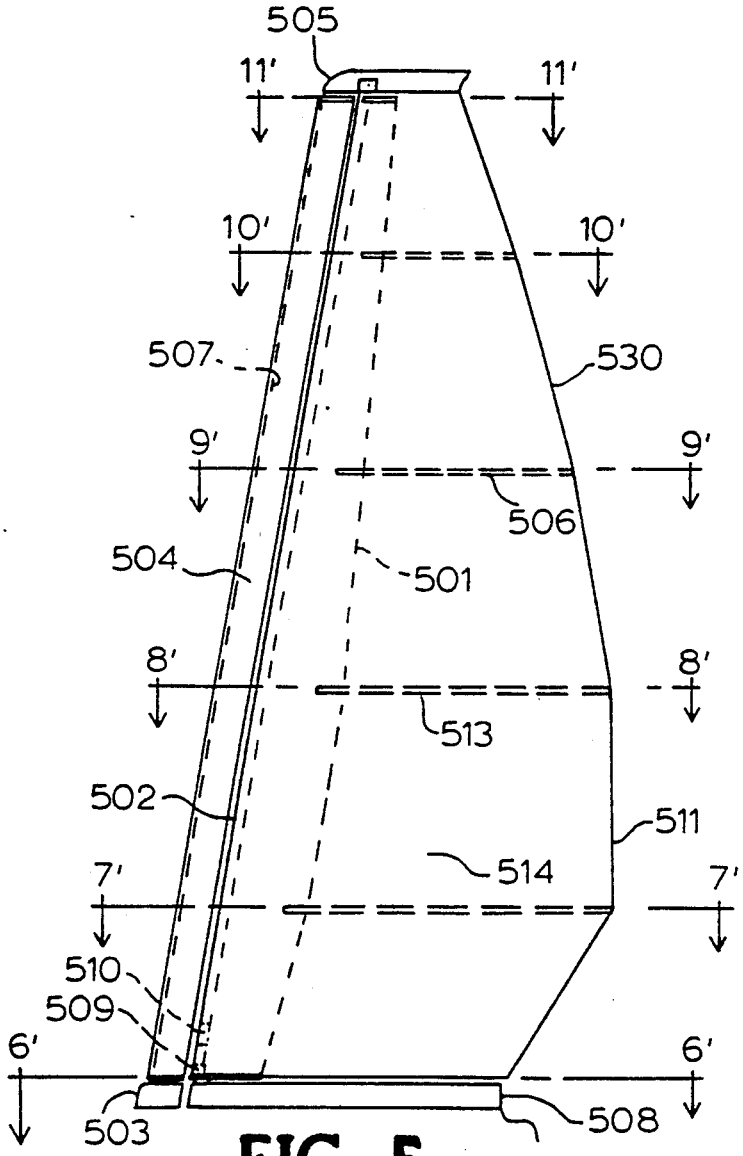
FIG. 5 is a side elevation view of an airfoil assembly according to another embodiment of the invention.
Figure 11:
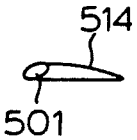
FIGS. 6, 7, 8, 9, 10, and 11 are cross-sectional views of the FIG. 5 airfoil, taken along lines 6—6, 7—7, 8—8, 9—9, 10—10, and 11—11 thereof, respectively.
Figure 10:
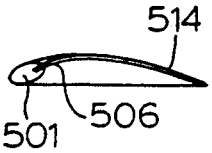
Figure 9:
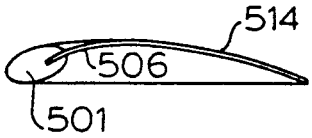

FIG. 5 is an elevation side view of an airfoil assembly according to another embodiment of the present invention, showing a mast 502, to which a camber inducer member 501 is coupled for rotational movement thereon.

The mast 502 at its upper extremity is secured to a tip member 505, and the mast is secured at its lower extremity to foot member 503. The lower portion of the mast contains a cylindrical cavity having mounted therein a lower mast post bushing 509 and an upper mast post bushing 510 to accommodate receipt of a wing post (not shown) in the cylindrical cavity.

Positioned forwardly of the mast is a slat 504 mounted on cable 507, and extending generally vertically, and parallel to the mast.

The slat is pivotally suspended on the cable 507 that passes downwardly through the leading edge of the slat and is tensioned between the front part of tip member 505 and the front part of foot member 503, allowing the trailing edge of the slat to swing freely from side-to-side about the cable.

The skin 514 forming the active panel surfaces of the airfoil assembly extends forwardly around the mast 502 and rearwardly to a trailing edge 530. The skin is not attached to the mast, so that it may freely move about the mast in use.

The flexible batten elements 506 are generally horizontally disposed and extend from the camber inducer member 501 rearwardly to the vicinity of the trailing edge 530 of the skin envelope.

At its forward extremity, the batten elements 506 are secured in respective batten sockets 513 associated with the camber inducer member, as hereinafter more fully described in connection with FIG. 13 hereof.

FIGS. 6–11 show respective cross-sectional views, taken along lines 6'—6', 7'—7', 8'—8', 9'—9', 10'—10', and 11'—11' of FIG. 5, representing the shape and camber profile at the successive elevations of the skin envelope, beginning with the lower cross-section in proximity to the foot member, up to a highest elevation cross section (FIG. 11) adjacent to the tip member.

As shown, the flexible batten elements 506 at sections 7'—7', 8'—8', 9'—9', and 10'—10', induce distention of the skin envelope to provide a desired camber profile in which the surface of the batten element characterized by convex curvature, is in abutting contact over a major portion of its length with the inner surface of a panel member of the skin envelope. The other panel is un-distended and of relatively flat profile. By the induction of such profile at the elevations associated with the batten elements, a corresponding (but somewhat attenuated) profile is induced at the uppermost (FIG. 11) and lowermost (FIG. 6) cross-sections.

Figure 8:
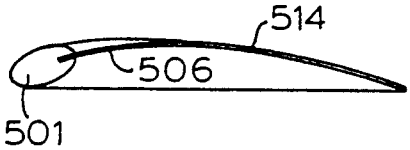
Figure 7:
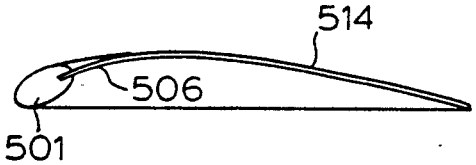
Figure 6:
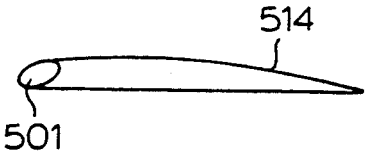
Figure 12:
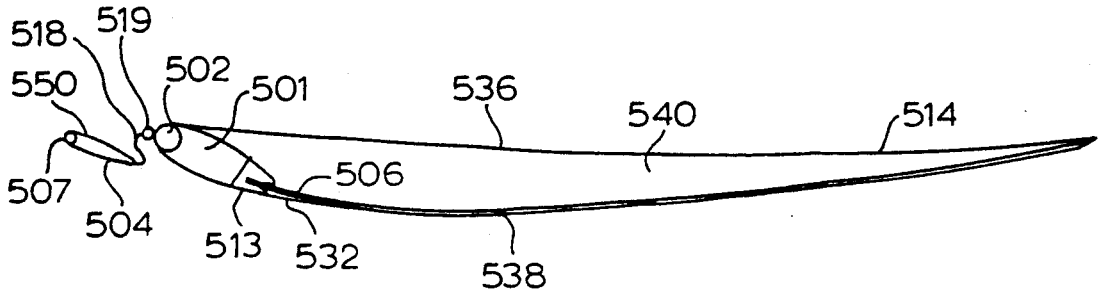
FIG. 12 is a cross-sectional view of the FIG. 5 airfoil, taken along line 8—8 thereof, in a camber position opposite the camber position shown in FIG. 8.

Referring now to FIG. 12, there is shown a cross-section view of the airfoil, taken along line 8'—8' of FIG. 5, in a cambered state opposite to that shown from the same cross-section in FIG. 8.

As shown in FIG. 12, the skin envelope 514 encloses the camber inducer member 501 as well as the batten element 506 reposed in the cavity 532 of batten insert 513. The skin envelope 514 thus is formed by the respective panels 536 and 538, which corporately enclose an interior volume 540.

The camber inducer member 501 is mounted for rotation on mast 502. The slat 504 comprises a cable 507 contained within a skin rigid shroud 550. The slat is pivotally suspended on cable 507 which as previously described passes downwardly through the leading edge of the slat and is tensioned between the front portion of the tip member and the front portion of the foot member, allowing the trailing edge of the slat to swing freely from side-to-side about the cable. A line 518 is attached to the approximate vertical center of the trailing edge of the slat 504 and passes through an eye 519 positioned on the front of the mast at its vertical mid-point. The line 518 then falls vertically to the bottom of the airfoil assembly, where it passes through a cleat-type locking device that is attached to the forward portion of the foot member, whereby side-to-side swing of the slat, and the size of the slot formed between the trailing edge of the slat and mast, may be readily controlled.

Figure 13:
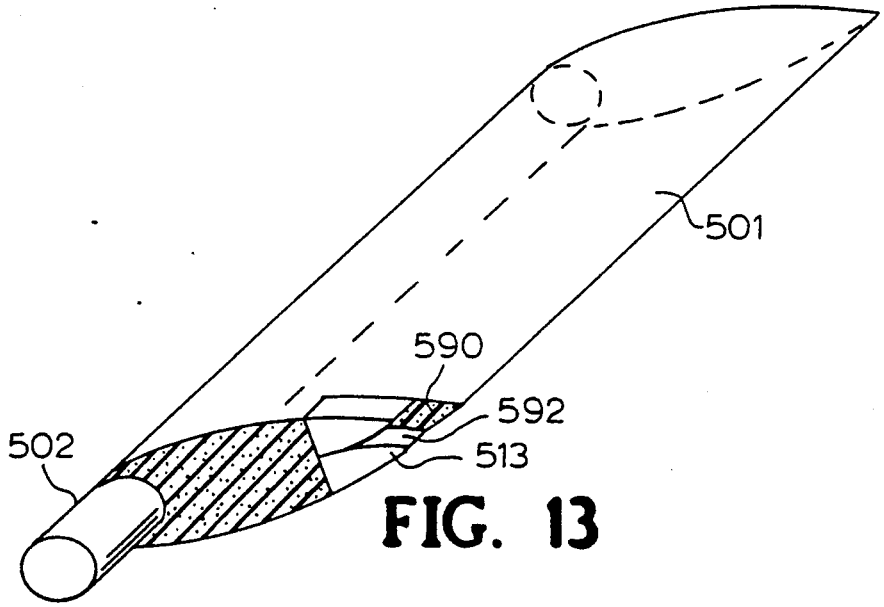
FIG. 13 is a perspective view of the main camber body and an associated slot-defining insert, of the airfoil assembly shown in FIG. 5.

FIG. 13 is a perspective view of a section of the mast and camber inducer member sub-assembly. As shown, the camber inducer member 501 is mounted on mast 502 for rotational movement thereon. The camber inducer member in this embodiment is generally coextensive in overall length with the mast, extending between the tip member and the foot member of the airfoil assembly. A batten insert cavity 590 is provided in the camber inducer member, in which a batten socket element 513 may be mounted.

The batten socket element 513 presents a rear cavity 592 bounded by arcuate converging wall surfaces forming an innermost slot in which the extremity of the batten element may be reposed. The arcuate surfaces of the cavity 592 permit the ready flexural displacement of the batten element, from the first of the respective batten camber positions, to the second such position opposite the first position, upon impingement on the exterior panel surface of the skin envelope of wind of sufficient speed and direction. Accordingly, a shift in wind direction, from a desired chamber position defined by the batten element distending against a specific one of the skin envelope panels, will cause reverse distension of the convex panel, thereby causing the batten element to "snap" to the opposite tack position in bearing relationship against the interior surface of the opposite skin envelope panel. To permit the "snap" the socket 513 has a V-shaped slot in which the elements of the V intersect at one end of each element, the batten element abutting only one or the other of the other ends of each element of the V, as also shown in FIG. 4, item 320. To optimally produce such recambering action, the flexible batten element is compressively positioned within the interior volume of the skin envelope, with respect to the force of the skin envelope and camber inducer element on the respective ends of the batten element. Accordingly, the batten element should have a length in proper dimensional relationship to the skin envelope, whereby such compressive positioning within the envelope interior volume can be readily effected, as for example by means of the overlapped end segment of one panel which is forwardly or rearwardly adjustible against the opposite panel exterior surface, as shown and described with reference to FIGS. 3A and 3B hereof (involving end flap 290 of skin panel 270).

While specific features, elements and embodiments of the invention have been shown and described herein, it will be appreciated that other variations, modifications, and embodiments are possible, and all such further variations, modifications, and embodiments are to be regarded as being with the spirit and scope of the invention.

What is claimed is:

1. A self-cambering double panel airfoil for wind-driven propulsion, including panels defining airfoil wind-engaging surfaces, said self-cambering airfoil comprising:

(i) a generally vertically positionable mast;

(ii) a camber inducer member secured to the mast for rotational movement about the axis of the mast, and extending rearwardly from the mast to a trailing portion having a batten realignment cavity therein bounded by facing, arcuate, forwardly converging wall surfaces forming at their forward extremity an innermost V-shaped slot in which the elements of the V intersect at one end of each element and in which an extremity of a flexible batten element is reposable, said batten element abutting only one or the other of the other ends of each element of the V, said facing, arcuate, forwardly converging wall surfaces permitting flexural recambering displacement of the flexible batten element when the camber inducer member repositions from a first camber position thereof to a second camber position thereof;

(iii) an elongate flexible batten element positioned at a leading edge thereof in the batten realignment cavity of the chamber inducer member and extending rearwardly therefrom to a trailing edge; and (iv) a skin covering comprising two main panels each extending rearwardly from the mast to a trailing edge and joined to one another at the respective trailing edges to form a trailing portion of the skin covering, the main panels being of a size and shape defining an enclosure containing the batten element, with the trailing edge of the batten element being in interior abutting contact with the skin covering at the trailing portion thereof and in a state of compression within the enclosure defined by the skin covering such that in the first camber position of the camber inducer member, the batten element interiorly abuts, distends and imparts a camber profile to a first one of the two main panels, and in the second camber position of the camber inducer member, the batten element interiorly abuts, distends, and imparts a camber profile to a second one of the two main panels.

2. A self-cambering airfoil according to claim 1, further comprising a generally horizontally aligned head member rigidly joined to an upper portion of the mast and extending rearwardly therefrom and a generally horizontally aligned foot member rigidly joined to a lower portion of the mast and extending rearwardly therefrom so that the mast with the head and foot members forms a unitary rigidified structure for airfoil alignment, and wherein the skin covering is coupled to the head member and foot member.

3. A self-cambering airfoil according to claim 1, further comprising a slat member generally coextensive in length with the mast and pivotally mounted forwardly of the mast and in parallel alignment therewith, the slat member having a trailing edge in spaced relationship to the skin covering to define a slot therebetween for enhancing the lift and thrust of the airfoil.

4. A self-cambering airfoil according to claim 1, wherein the enclosure defined by the skin covering contains the camber inducer member therewithin.

5. A self-cambering airfoil according to claim 1, further comprising a multiplicity of batten elements associated with at least one camber inducer member, wherein the batten elements are in vertically spaced-apart relationship to one another.

6. A self-cambering airfoil according to claim 5, comprising a multiplicity of discrete unitary camber inducer members disposed in spaced-apart relationship to one another along the length of the mast and independently secured to the mast for rotational movement about the axis of the mast, and wherein the flexible batten element reposed in the respective camber inducer members are devoid of any interconnection means intermediate their leading edges and trailing edges.

7. A self-cambering airfoil according to claim 1, wherein the camber inducer member comprises a main camber body including a convergent forward portion with a C-shaped cylindrical frontal member defining an interior cavity therewithin and engaging the mast for rotational movement about the axis of the mast, an intermediate portion with arcuate convexly curved exterior side surfaces, and a convergent rearward portion having said batten realignment cavity therein.

8. A self-cambering airfoil according to claim 1, wherein the camber inducer member comprises a main camber body of vertically elongate and horizontally streamline shape including a convergent forward portion engaging the mast along substantially its entire length for rotational movement about the axis of the mast, and a convergent rearward portion, with a horizontal and forwardly extending slot in the convergent rearward portion of the main camber body, and a batten socket insert mounted in the horizontal and forwardly extending slot, the batten socket insert having said batten realignment cavity therein.

9. A self-cambering airfoil according to claim 8, comprising a multiplicity of horizontal and forwardly extending slots in the main camber body, in vertically spaced apart relationship to one another, each of the horizontal and forwardly extending slots having a batten socket insert mounted therein.

10. A self-cambering airfoil according to claim 1, wherein the skin covering is formed of a fabric material of construction.

11. A craft comprising a pylon having a wing post mounted thereon and extending upwardly therefrom, with a self-cambering double panel airfoil for wind-driven propulsion of the craft, including panels defining airfoil wind-engaging surfaces, said self-cambering airfoil being mounted on the wing post for rotation about the wing post, the self-cambering airfoil comprising:

(i) a generally vertically positionable mast journaled about the wing post for rotation of the mast thereon;

(ii) a camber inducer member secured to the mast for rotational movement about the axis of the mast, and extending rearwardly from the mast to a trailing portion having a batten realignment cavity therein bounded by facing, arcuate, forwardly converging wall surfaces forming at their forward extremity an innermost V-shaped slot in which the elements of the V intersect at one end of each element and in which an extremity of a flexible batten element is reposable, said batten element abutting only one or the other of the other ends of each element of the V, said facing, arcuate, forwardly converging wall surfaces permitting flexural recambering displacement of the flexible batten element when the camber inducer member repositions from a first camber position thereof to a second camber position thereof;

(iii) a elongate flexible batten element positioned at a leading edge thereof in the batten realignment cavity of the camber inducer member and extending rearwardly therefrom to a trailing edge; and (iv) a skin covering comprising two main panels extending rearwardly from the mast to a trailing edge and joined to one another at their respective trailing edges to form a trailing portion of the skin covering, the main panels being of a size and shape defining an enclosure containing the batten element, with the trailing edge of the batten element being in interior abutting contact with the skin covering at the trailing portion thereof and in a state of compression within the enclosure defined by the skin covering such that in the first cambering position of the camber inducer member, the batten element interiorly abuts, distends and imparts a camber profile to a first one of the two main panels, and in the second camber position of the camber inducer member, the batten element interiorly abuts, distends and imparts a camber profile to a second one of the two main panels.

12. A craft according to claim 11, further comprising a generally horizontally aligned head member rigidly joined to an upper portion of the mast and extending rearwardly therefrom and a generally horizontally aligned foot member rigidly joined to a lower portion of the mast and extending rearwardly therefrom so that the mast with the heated and foot members forms a unitary rigidified structure for airfoil alignment, and wherein the skin covering is coupled to the head member and foot member.

13. A craft according to claim 11, further comprising a slat member generally coextensive in length with the mast and pivotally mounted forwardly of the mast and in parallel alignment therewith, the slat member having a trailing edge in spaced relationship to the skin covering to define a slot therebetween for enhancing the lift and thrust of the airfoil.

14. A craft according to claim 11, wherein the enclosure defined by the skin covering contains the camber inducer member therewithin.

15. A craft according to claim 11, further comprising a multiplicity of batten elements associated with at least one camber inducer member, wherein the batten elements are in vertically spaced-apart relationship to one another.

16. A craft according to claim 15, comprising a multiplicity of discrete unitary camber inducer members disposed in spaced-apart relationship to one another along the length of the mast and independently secured to the mast for rotational movement about the axis of the mast, and wherein the flexible batten members reposed in the respective camber inducer members are devoid of any interconnection means intermediate their leading edges and trailing edges.

17. A craft according to claim 11, wherein the camber inducer member comprises a main camber body including a convergent forward portion with a C-shaped cylindrical frontal member defining an interior cavity therewithin and engaging the mast for rotational movement about the axis of the mast, an intermediate portion with arcuate convexly curved exterior side surfaces, and a convergent rearward portion having said batten realignment cavity therein.

18. A craft according to claim 11, wherein the camber inducer member comprises a main camber body of vertically elongate and horizontally streamline shape including a convergent forward portion engaging the mast along substantially its entire length for rotational movement about the axis of the mast, and a convergent rearward portion, with a horizontal and forwardly extending slot in the convergent rearward portion of the main camber body, and a batten socket insert mounted in the horizontal and forwardly extending slot, the batten socket insert having said batten realignment cavity therein.

19. A craft according to claim 18, comprising a multiplicity of horizontal and forwardly extending slots in the main camber body, in vertically spaced-apart relationship to one another, each of the horizontal and forwardly extending slots having a batten socket insert mounted therein.

20. A craft according to claim 11, wherein the skin covering is formed of a fabric material of construction.

* * * * *